US008042716B2

(12) United States Patent
Lun

(10) Patent No.: US 8,042,716 B2
(45) Date of Patent: Oct. 25, 2011

(54) DONNING DEVICE FOR STOCKINGS

(75) Inventor: Bertrand Lun, St. Etienne (FR)

(73) Assignee: Ganzoni Management AG (CH)

( * ) Notice: Subject to any disclaimer, the term of this patent is extended or adjusted under 35 U.S.C. 154(b) by 786 days.

(21) Appl. No.: 12/093,645

(22) PCT Filed: Nov. 17, 2006

(86) PCT No.: PCT/CH2006/000650

§ 371 (c)(1),
(2), (4) Date: May 14, 2008

(87) PCT Pub. No.: WO2007/059641

PCT Pub. Date: May 31, 2007

(65) Prior Publication Data

US 2008/0277431 A1 Nov. 13, 2008

(30) Foreign Application Priority Data

Nov. 24, 2005 (EP) ..... 05025624

(51) Int. Cl.
*A47G 25/80* (2006.01)

(52) U.S. Cl. ..... 223/111

(58) Field of Classification Search ..... 223/111–112
See application file for complete search history.

(56) References Cited

U.S. PATENT DOCUMENTS

| | | | | |
|---|---|---|---|---|
| 5,356,057 | A | 10/1994 | Vossen | |
| 5,601,220 | A | 2/1997 | Vossen | |
| 5,673,826 | A | 10/1997 | Stolk | |
| 5,799,844 | A | 9/1998 | James | |
| 5,826,761 | A | 10/1998 | Basaj | |
| 5,909,831 | A * | 6/1999 | Griffin | 223/112 |
| 5,924,609 | A | 7/1999 | Stolk et al. | |
| 6,523,729 | B1 | 2/2003 | Gardon-Mollard | |
| 6,868,997 | B1 * | 3/2005 | Maguire | 223/118 |
| 7,234,616 | B2 * | 6/2007 | Thom et al. | 223/112 |
| 7,699,195 | B2 * | 4/2010 | Scott | 223/111 |
| 2004/0178234 | A1 | 9/2004 | Sawlewicz | |
| 2007/0119882 | A1 | 5/2007 | Scott | |
| 2009/0242593 | A1 * | 10/2009 | Hildebrandt | 223/111 |

FOREIGN PATENT DOCUMENTS

| | | |
|---|---|---|
| CA | 2272661 | 5/1999 |
| DE | 202 17 525 | 2/2003 |
| WO | WO 99/44558 | 9/1999 |

OTHER PUBLICATIONS

International Search Report and Written Opinion of Patent Application No. PCT/CH2006/000650 dated Feb. 1, 2007.
European Search Report of Patent Application No. 05025624.7 dated May 31, 2006.
International Search Report dated Feb. 1, 2007 issued in corresponding PCT Application No. PCT/CH2006/000650.

* cited by examiner

*Primary Examiner* — Shaun R Hurley
*Assistant Examiner* — Andrew Sutton
(74) *Attorney, Agent, or Firm* — Ostrolenk Faber LLP

(57) ABSTRACT

A device that makes donning of stockings, in particular medical compression stockings, easier has a flexible sheet body that has a low friction inner side and a high friction outer side and is closed by snap fasteners. It can be rolled to a tubular shape having a larger diameter at one end. The sheet body is inserted into a stocking with the end of lower diameter first and is then pulled over the foot and leg, with the device reducing the friction forces that have to be exerted.

15 Claims, 2 Drawing Sheets

DONNING DEVICE FOR STOCKINGS

CROSS REFERENCES TO RELATED APPLICATIONS

The present application is a 35 U.S.C. §§371 national phase conversion of PCT/CH2006/000650, filed Nov. 17, 2006, which claims priority of European patent application 05 025 624.7, filed Nov. 24, 2006, the disclosure of which is incorporated herein by reference in its entirety. The PCT International Application was published in the English language.

TECHNICAL FIELD

The invention generally relates to donning devices for stockings according to the preamble of the independent claims.

Such a donning device helps the user to don a stocking. Donning devices have e.g. been described in U.S. Pat. No. 5,601,220 and WO 99/44558. They have generally tubular shape and can be applied over the leg for easing the donning procedure. In some embodiments, known donning devices comprise two fabric layers to make it easier to remove the donning device after donning the stocking.

SUMMARY OF THE INVENTION

It is an object of the present invention to further improve the ease of use of such donning devices and reduce its cost. This object is achieved by the donning device of claim 1.

This design allows to use the device by first inserting it into the stocking—this procedure is the opposite way than described in the above mentioned patent—, then pulling the device with the stocking over one's leg and finally removing the device.

In an advantageous embodiment the sheet body has an inner fabric layer that forms the inside of the tubular shaper as well as an outer fabric layer forming its outside. The inner fabric layer is of a material having lower friction than the outer fabric layer. The low friction inner fabric layer allows to pull the device and stocking over the leg with low effort, while the high friction outer fabric layer helps to drag the stocking along.

In another advantageous embodiment, the sheet body of the donning device is provided with snap fasteners. By snapping pairs of the snap fasteners together, the tubular shape can be formed. Using snap fasteners in this context is advantageous because snap fasteners do not have the tendency to attach themselves to the stockings (in contrast to Velcro), which avoids damaging the same. However, the snap faster could be replaced by other temporary attachment means such as magnetic parts.

In a third advantageous embodiment, a handle is formed at a rim of the tubular body by means of a ribbon section. The ribbon section extends along the rim. Such a handle is manufactured and used easily. Preferably, the ribbon section forms a pocket with the sheet body, said pocket being closed at first side along the rim and being open at a second side opposite the first side. This design provides a stable handle that gripped securely, while it allows to hold on to the upper edge of stocking at the same time.

The term "tubular shape" designates cylindrical as well as frusto-conical tube shapes, i.e. the tube shape does not necessarily have constant diameter.

BRIEF DESCRIPTION OF THE DRAWINGS

Further advantageous embodiments are described in the dependent claims as well as in the following detailed description. The description makes reference to the annexed figures, which show:

EMBODIMENTS OF THE INVENTION

Figure 1:
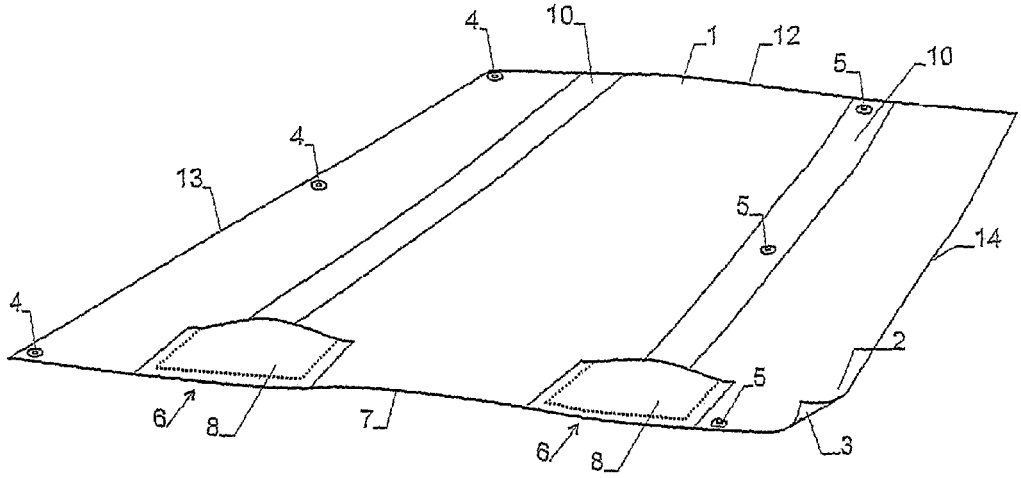
FIG. 1 the sheet body of a donning device prior to being rolled into a tubular shape, FIG. 2 a side view of the sheet body of FIG. 1, and FIG. 3 the sheet body of FIG. 1 rolled into a tubular shape.
Figure 2:
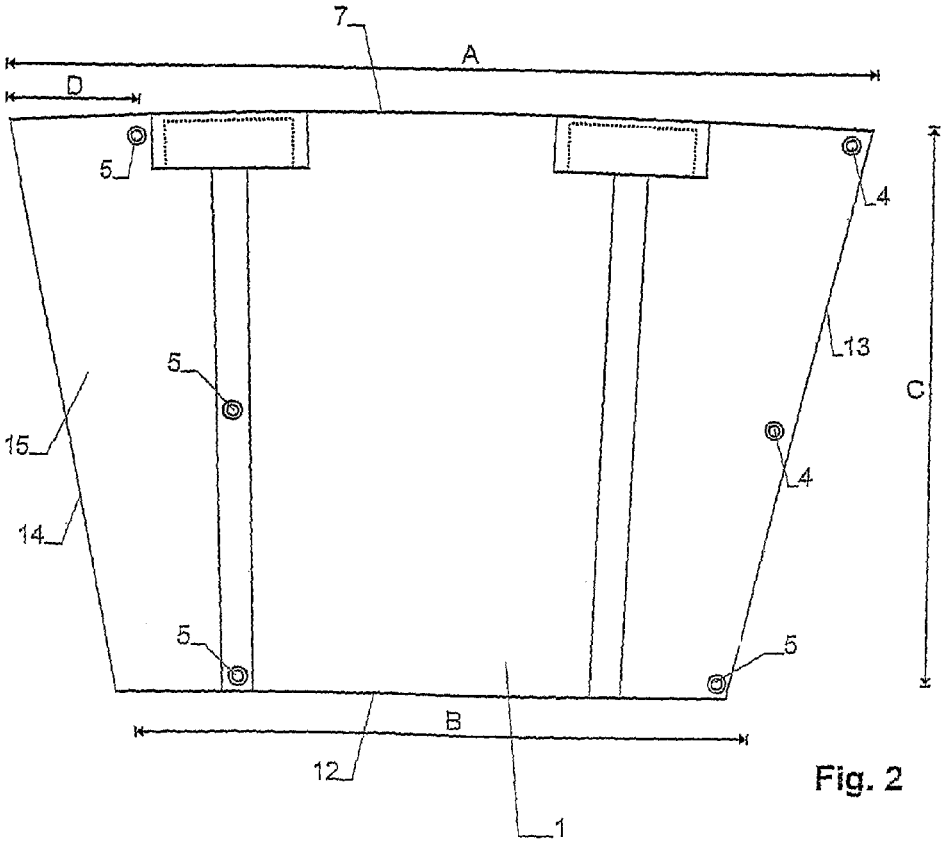
Figure 3:
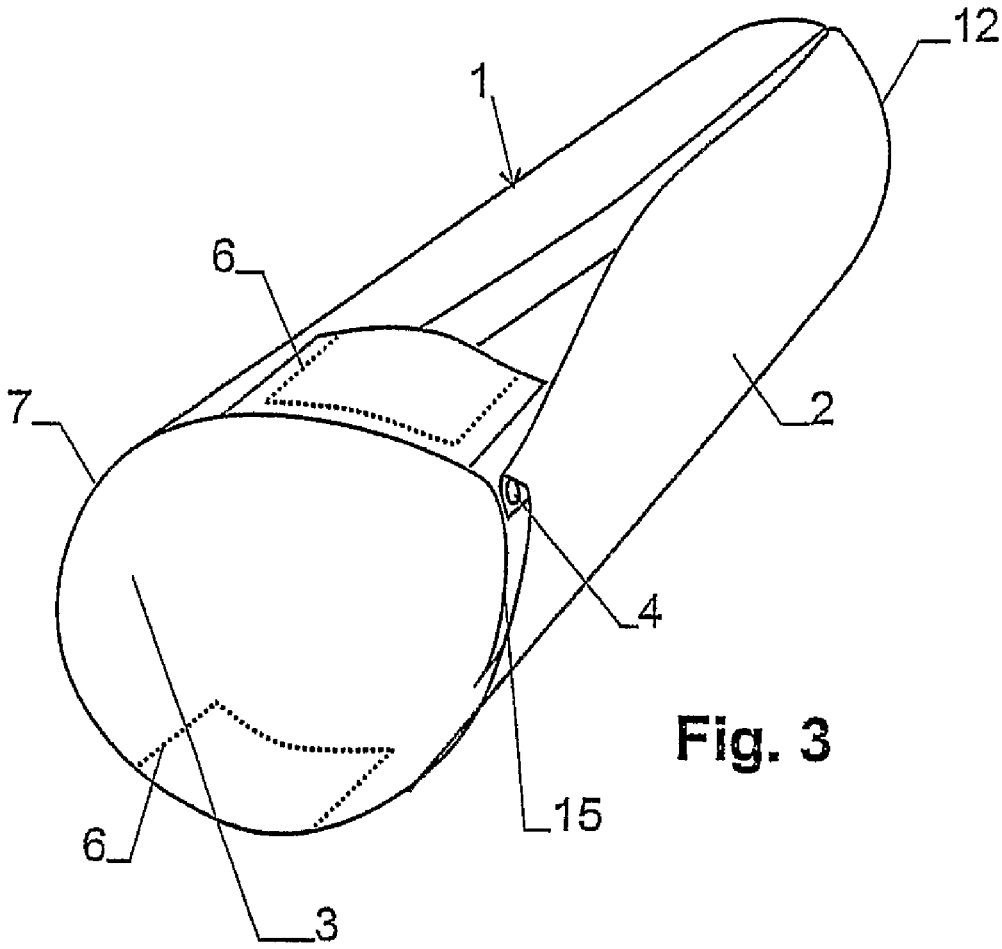

An advantageous embodiment of the invention is shown in FIGS. 1 to 3. The donning device comprises a sheet body 1. Prior to being rolled into tubular shape as described below, sheet body 1 is substantially trapezoidal. Advantageously, it has a top width A of approximately 55 cm, a bottom width B of approximately 37 cm and a height C of approximately 39 cm.

Base body 1 is flexible and preferably formed by two layers of fabric, namely an outer fabric layer 2 and an inner fabric layer 3, which are interconnected, e.g. by means of stitches along all edges for preventing a large movement between the two layers 2, 3. There is not any relative movement between the inner and outer layers.

For reasons that will be come clear in the following, outer fabric layer 2 is of a material having higher friction than inner fabric layer 3. Advantageously, inner fabric layer 3 is coated by an anti-frictional coating, advantageously silicon, or any similar material, such as Teflon. Both fabric layers are preferably formed by woven threads. Alternatively, one or both can be formed by a plastic foil or plastic foils, respectively.

Female and male snap fasteners or magnetic fasteners 4 and 5 are attached to sheet body 1, namely to its outer side (i.e. the side that is formed by outer fabric layer 2). As described below, sheet body 1 can be rolled up into a tubular shape and the male and female snap fasteners can then be connected to each other for stabilizing this tubular shape.

Two handles 6 are located at the top rim 7 of shape body 1. Each handle 6 comprises a ribbon section 8 extending substantially parallel to top rim 7. Ribbon section 8 is stitched to sheet body 1 along its top and side edges, while it remains unconnected to sheet body 1 along its bottom edge, thereby forming a pocket with sheet body 1, which pocket is closed at first side along rim 7 and open at a second side opposite the first side.

A reinforcing ribbon 10 extends from each handle 6 along at least part of the height of sheet body 1. Each reinforcing ribbon 10 is of a more tear-resistant material than the fabric layers 2 or 3 and serves to distribute the force exerted to the handles onto sheet body 1 when the device is donned. This reinforcement part (ribbon) could sewn either on the inner side or on the outer side or advantageously between the 2 layers.

The don a stocking, in particular a medical compression stocking, using the present device, the device is first rolled up into a tubular shape as shown in FIG. 3, with outer fabric layer 2 forming the outer surface of the tubular shape and inner fabric layer 3 forming its inner surface.

Hence, the snap fasteners 4, 5 are facing outwards. Since all snap fasteners are attached to the same side of sheet body 1, one lateral rim, namely rim 13 that has snap fasteners affixed adjacent to it, has to be folded by 180° to allow the female snap fasteners 4 to engage the male snap fasteners 5. This technique has the advantage that the snap fasteners will open easily and automatically when the tubular shape is expanded radially, e.g. by being pulled over the heel as described below.

As can be seen e.g. from FIG. 2, one row of snap fasteners, in the shown embodiment the row of male snap fasteners 5, is located at a distance D from the corresponding lateral rim 14 of sheet body 1. Advantageously, and as for reasons that will become apparent below, distance D is at least 8 cm. Hence, when sheet body 1 is rolled into the tubular shape, an edge region 15 of the sheet body will form an overlap beyond the snap fasteners 4, 5. This region will have a width of at least 8 cm. The purpose of the overlap will be described below.

The snap fasteners 4, 5 are positioned such on sheet body 1 that a top circumference at top rim 7 of the tubular shape is at least 40 cm, preferably approximately 45 cm, while a bottom circumference at bottom rim 12 is no more than 30 cm, preferably approximately 27 cm.

The handles 6 are positioned to be on opposite sides of the tubular shape when sheet body 1 is in its rolled up state.

Once that sheet body 1 has been rolled into the tubular shape and the snap fasteners 4, 5 have been fastened, the device is inserted into a stocking with bottom rim 12 first. Once that it is fully inserted, advantageously with bottom rim 12 being at the height of the foot of the stocking, the top part of the stocking as well as the two handles are seized by the user and pulled over the wearer's foot. Since the low friction inner fabric layer 3 is facing the skin, the device and stocking will slide easily over foot and heel.

The top opening of the device with its circumference of at least 40 cm is generally large enough to pass the patient's heel. The closer the heel gets to the bottom rim 12, the less space it will have. At some point, since most heels will not fit through an opening having a circumference of 30 cm, the heel will start to expand the device, which will cause at least the bottom most snap fasteners 4, 5 to open. This will allow the device to expand, while the overlap 15 still prevents the stocking from coming into contact with the patient's skin, i.e. friction will still be low.

Once that the stocking has been pulled up sufficiently, the donning device can further be pulled upwards after releasing the stocking. At the same time, if necessary, any unopened snap fasteners 4, 5 can be opened and the device can be removed from the leg.

The present invention has so far been described for one specific embodiment shown in the figures. It must be noted that it also can be practiced differently.

For example, the snap fasteners 4, 5 can be replaced by a permanent connection if the circumference of the device, in particular at its bottom end, is chosen to be sufficiently large to pass over the heel. In that case, the device will always have tubular shape.

Furthermore, sheet body 1 can be formed by a single fabric layer only. If it is desired that its inner surface has lower friction than its outer surface, the fabric layer can be coated e.g. by a low friction coating, such as a silicon, on one side.

As mentioned above, the term fabric is to be construed broadly and is not restricted to textile fabrics but encompasses foils or non woven such as Tyvek as well.

While there are shown and described presently preferred embodiments of the invention, it is to be distinctly understood that the invention is not limited thereto but may be otherwise variously embodied and practiced within the scope of the following claims.

What is claimed is:

1. A donning device for stockings comprising a flexible sheet body formed into or configured to be formed into a tubular shape, wherein said sheet body is configured to be inserted into a stocking in tubular shape and for being pulled, together with the stocking, over a leg;

said sheet body comprises an inner fabric layer forming an inner side surface of said tubular shape and an outer fabric layer forming an outer side surface of said tubular shape, wherein said inner fabric layer is of a material having lower friction than said outer fabric layer.

2. The donning device of claim 1, wherein said inner fabric layer comprises threads having an anti-frictional coating.

3. The donning device of claim 1 comprising snap fasteners attached to said sheet body, wherein said tubular shape is formed by connecting pairs of said snap fasteners to each other.

4. The donning device of claim 3 wherein said snap fasteners are all attached on a same side of said sheet body.

5. The donning device of claim 3 wherein, with said snap fasteners connected to form said tubular shape, at least one region of said sheet body overlaps beyond said snap fasteners at least by 8 cm.

6. The donning device of claim 3 comprising at least one handle arranged at a rim of said sheet body for pulling said tubular shape onto the leg.

7. The donning device of claim 6, wherein said handle is formed by a ribbon section extending parallel to said rim.

8. The donning device of claim 6 comprising two handles arranged to be positioned at opposite sides of said tubular shape.

9. The donning device of claim 6 further comprising at least one reinforcing ribbon arranged to extend from said handle along at least part of a longitudinal axis of said tubular shape for distribution of a force exerted on said handle onto said sheet body.

10. The donning device of claim 1, wherein said tubular shape has a circumference of at least 40 cm at a first end thereof and a circumference of no more than 30 cm at a second end thereof.

11. The donning device of claim 1 comprising magnetic fasteners attached to said sheet body, at locations on said sheet body such that said tubular shape is formed by connecting pairs of said magnetic fasteners to each other.

12. The donning device of claim 2, wherein said inner fabric layer threads have an anti-frictional silicon coating.

13. The donning device of claim 7, wherein said ribbon section forms a pocket with said sheet body, said pocket being closed at a first side thereof along said rim and open at a second side thereof opposite said first side.

14. A donning device for stockings comprising a flexible sheet body formed into or configured to be formed into a tubular shape, wherein said sheet body is configured to be inserted into a stocking in tubular shape and for being pulled, together with the stocking, over a leg;

snap fasteners attached to said sheet body, wherein said tubular shape is formed by connecting pairs of said snap fasteners to each other to form said tubular shape, and at least one region of said sheet body overlaps beyond said snap fasteners at least by 8 cm.

15. A donning device for stockings comprising a flexible sheet body formed into or suitable to be formed into a tubular shape, wherein said sheet body is suited to be inserted into a stocking in tubular shape and for being pulled, together with the stocking, over a leg, snap fasteners attached to said sheet body, wherein said tubular shape is formed by connecting pairs of said snap fasteners to each other; and at least one handle arranged at a rim of said sheet body for pulling said tubular shape onto the leg, wherein said handle is formed by a ribbon section extending parallel to said rim.

* * * * *